US009401108B2

(12) United States Patent
Park et al.

(10) Patent No.: US 9,401,108 B2
(45) Date of Patent: Jul. 26, 2016

(54) ORGANIC LIGHT EMITTING DISPLAY AND METHOD OF DRIVING THE SAME

(71) Applicant: LG Display Co., Ltd., Seoul (KR)

(72) Inventors: Dongwon Park, Goyang-si (KR); Yongchul Kwon, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 14/965,713

(22) Filed: Dec. 10, 2015

(65) Prior Publication Data

US 2016/0189597 A1 Jun. 30, 2016

(30) Foreign Application Priority Data

Dec. 24, 2014 (KR) ..... 10-2014-0188863

(51) Int. Cl.
*G09G 3/32* (2016.01)
*G09G 3/20* (2006.01)

(52) U.S. Cl.
CPC ..... *G09G 3/2074* (2013.01); *G09G 3/3225* (2013.01); *G09G 2320/0233* (2013.01)

(58) Field of Classification Search
CPC ..... G09G 3/2074; G09G 3/3225; G09G 2320/0233; G09G 2320/045; G09G 2310/0251
See application file for complete search history.

(56) References Cited

U.S. PATENT DOCUMENTS

2007/0080906 A1 4/2007 Tanabe
2007/0262935 A1* 11/2007 Shin ..... G09G 3/3291 345/84
2012/0075363 A1* 3/2012 Kim ..... G09G 3/2022 345/691
2014/0192098 A1* 7/2014 Kimura ..... G09G 3/3233 345/690
2014/0375618 A1* 12/2014 Marcotte ..... G09G 3/3225 345/211
2015/0028766 A1* 1/2015 Yang ..... G09G 3/3225 315/240
2015/0243210 A1* 8/2015 Park ..... G09G 3/3208 345/691

OTHER PUBLICATIONS

European Partial Search Report, European Application No. 15200320.8, Mar. 23, 2016, 6 pages.

* cited by examiner

*Primary Examiner* — Premal Patel
(74) *Attorney, Agent, or Firm* — Fenwick & West LLP

(57) ABSTRACT

A data driver supplies a data signal to a display panel to control luminance of a plurality of pixels. The data signal comprises a plurality of frames, and each of the frames comprises a plurality of sub-frames. Each of the sub-frames comprises an addressing time, followed by an emission time, followed by an erase time. Subpixels each include a first scan line switch controlled by the first scan line signal to turn on during the addressing time of each sub-frame and to turn off during the emission time and the erase time of each sub-frame. A second scan line switch is controlled by a second scan line signal to provide a discharge path to discharge the storage capacitor during the erase time of each sub-frame.

13 Claims, 6 Drawing Sheets

ORGANIC LIGHT EMITTING DISPLAY AND METHOD OF DRIVING THE SAME

This application claims the benefit of Korean Patent Application No. 10-2014-0188863, filed on Dec. 24, 2014, which is incorporated herein by reference for all purposes as if fully set forth herein.

BACKGROUND

1. Field

The present invention relates to an Organic Light Emitting Display (OLED) and a method of driving the same.

2. Related Art

An organic light emitting element used for an OLED is a self-luminance element in which a light emitting layer is formed between two electrodes. By injecting electrons and holes from an electron cathode and a hole anode, respectively, into a light emitting layer, the organic light emitting element is an element that emits light when excitons in which the injected electrons and holes are coupled drop from an excited state to a ground state.

When a scan signal, a data signal, and power are supplied to a display panel including a plurality of subpixels disposed in a matrix form, the OLED enables selected subpixels to emit light, thereby displaying an image.

A driving method of the OLED includes an analog driving method of driving a display panel by supplying a current or a voltage to the display panel and a digital driving method of adjusting an emission time. The digital driving method includes an Address Display Separation (ADS) driving method and an Address While Display (AWD) driving method.

The AWD driving method is implemented so that lengths of subframes have different weighted times or emission times. In the AWD driving method, a subpixel is turned on and turned off in every subframe and in this case, luminance is determined in proportional to accumulation of a turn-on time of the subpixel.

In a conventionally suggested AWD driving method, an erase time (Erase) that erases a data signal is inserted into only subordinate subframes having a time smaller than 1 horizontal addressing time (1V addressing). Therefore, in a conventionally suggested AWD driving method, an error occurs that changes a voltage that determines actual luminance of a subpixel for a present subframe according to a state (turn on or turn off) of a subpixel for a previous subframe. As a result, in the conventionally suggested AWD driving method, an image quality deviation occurs due to an error occurrence factor and thus enhancement thereof is requested.

SUMMARY

The present invention relates to a display device comprising a display panel, a data driver, and a scan driver. The display panel comprises a plurality of pixels for displaying an image. Each of the plurality of pixels comprises a plurality of subpixels for displaying different components of the pixels. The data driver supplies a data signal to the display panel to control luminance of the plurality of pixels. The data signal comprises a plurality of frames, and each of the frames comprises a plurality of sub-frames. Each of the sub-frames comprises an addressing time, followed by an emission time, followed by an erase time. The scan driver supplies first and second scan line signals to the display panel. Each of the subpixels is driven by the frames including the plurality of subframes. Furthermore, each of the subpixels comprises a first scan line switch, a storage capacitor, a driving transistor, a light emitting diode, and a second scan line switch. The first scan line switch is controlled by the first scan line signal to turn on during the addressing time of each sub-frame and to turn off during the emission time and the erase time of each sub-frame. The storage capacitor stores a data voltage corresponding to the data signal when the first scan line switch is on during the addressing time of each sub-frame and discharges the data voltage during the erase time of each sub-frame. The driving transistor has a gate electrode coupled to the storage capacitor. The driving transistor turns on during the emission time of each sub-frame when the data voltage of the storage capacitor meets a threshold voltage of the driving transistor and turns off during the addressing time and the erase time of each sub-frame when the data voltage does not meet the threshold voltage. The light emitting diode is coupled to the driving transistor. The light emitting diode emits light when the driving transistor is on during the emission time to drive current through the light emitting diode. The second scan line switch is controlled by the second scan line signal to provide a discharge path to discharge the storage capacitor during the erase time of each sub-frame.

In another embodiment, a method is provided for driving a display device comprising a plurality of pixels for displaying an image, in which each of the plurality of pixels comprises a plurality of subpixels for displaying different components of the pixels. A data driver supplies a data signal to the display panel to control luminance of the plurality of pixels. The data signal comprises a plurality of frames, and each of the frames comprises a plurality of sub-frames. Each of the sub-frames comprises an addressing time, followed by an emission time, and followed by an erase time. A scan driver supplies first and second scan line signals to the display panel. During the addressing time of each sub-frame, a first scan line switch is controlled via the first scan line signal to turn on to couple a storage capacitor to the data signal and to cause the storage capacitor to store a data voltage corresponding to the data signal. Responsive to the data voltage of the storage capacitor meeting a threshold voltage of a driving transistor having a gate electrode coupled to the storage capacitor, the driving transistor is caused to turn on during the emission time of each sub-frame. The first scan line switch is turned off during the emission time of each sub-frame. When the driving transistor is on during the emission time of each sub-frame, a drive current is caused to flow through a light emitting diode. The light emitting diode emits light in response to the drive current. During the erase time of each sub-frame, a second scan line switch is controlled via the second scan line signal to turn on. The second scan line switch provides a discharge path to discharge the data voltage of the storage capacitor and cause the driving transistor to turn off and cause the light emitting diode to cease emitting light.

BRIEF DESCRIPTION OF THE DRAWINGS

The accompany drawings, which are included to provide a further understanding of the invention and are incorporated on and constitute a part of this specification illustrate embodiments of the invention and together with the description serve to explain the principles of the invention.

DETAILED DESCRIPTION

Reference will now be made in detail embodiments of the invention examples of which are illustrated in the accompanying drawings.

Hereinafter, exemplary embodiments of the present invention will be described in detail with reference to the accompanying drawings.

First Exemplary Embodiment

Figure 1:
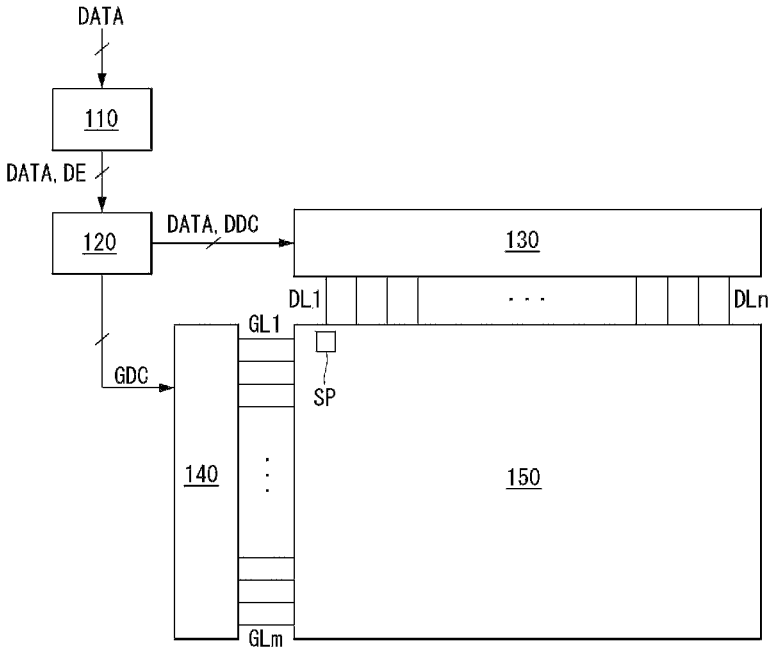
FIG. 1 is a block diagram illustrating a configuration of an OLED according to a first exemplary embodiment of the present invention.
Figure 2:
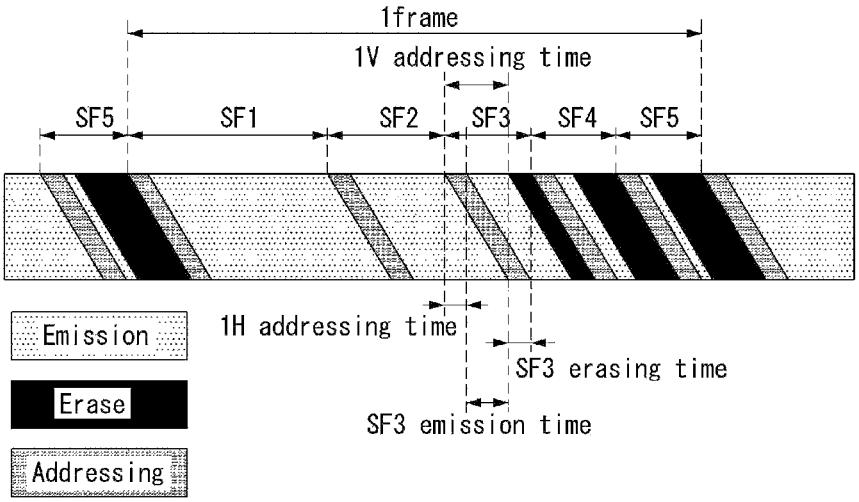
FIG. 2 is a diagram illustrating a conventional AWD driving method.
Figure 3:
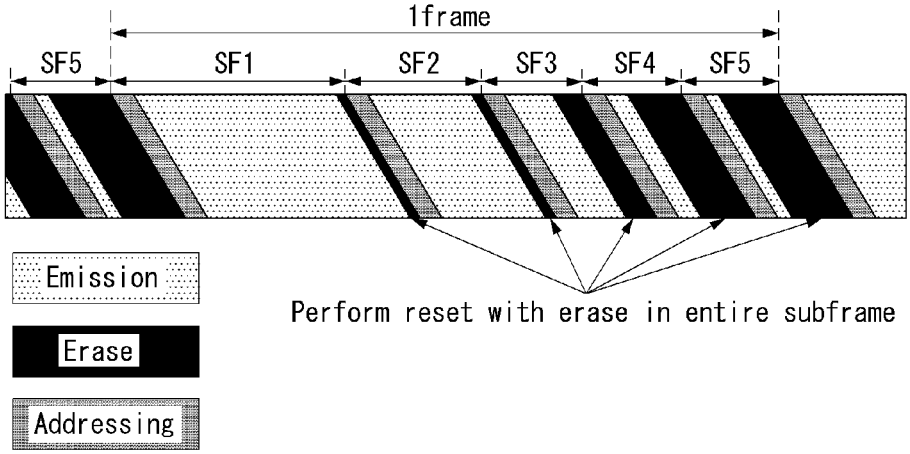
FIG. 3 is a diagram illustrating an AWD driving method according to an exemplary embodiment of the present invention.

FIG. 1 is a block diagram illustrating a configuration of an Organic Light Emitting Display (OLED) according to a first exemplary embodiment of the present invention, FIG. 2 is a diagram illustrating a conventional AWD driving method, and FIG. 3 is a diagram illustrating an AWD driving method according to an exemplary embodiment of the present invention.

As shown in FIG. 1, an OLED according to a first exemplary embodiment of the present invention includes an image processor 110, a timing controller 120, a data driver 130, a scan driver 140, and a display panel 150.

The image processor 110 outputs a data enable signal DE together with a data signal DATA supplied from the outside. The image processor 110 may output at least one of a vertical synchronization signal, a horizontal synchronization signal, and a clock signal in addition to the data enable signal DE, but for convenience of description, the signals will be omitted.

The timing controller 120 receives the supply of a data signal DATA together with a driving signal including a data enable signal DE or a vertical synchronization signal, a horizontal synchronization signal, and a clock signal from the image processor 110. The timing controller 120 outputs a gate timing control signal GDC for controlling operation timing of the scan driver 140 and a data timing control signal DDC for controlling operation timing of the data driver 130 based on a driving signal.

The data driver 130 samples and latches a data signal DATA supplied from the timing controller 120 in response to a data timing control signal DDC supplied from the timing controller 120 and converts and outputs the data signal DATA to a gamma reference voltage. The data driver 130 outputs a data signal DATA arranged in a subframe (or subfield) unit through data lines DL1-DLn. The data driver 130 is formed in an Integrated Circuit (IC) form.

The scan driver 140 outputs a scan signal while shifting a level of a gate voltage in response to a gate timing control signal GDC supplied from the timing controller 120. The scan driver 140 outputs a scan signal through scan lines GL1-GLm. The scan driver 140 is formed in an Integrated Circuit (IC) form or is formed in a Gate In Panel method in the display panel 150.

The display panel 150 displays an image to correspond to a data signal DATA and a scan signal supplied from the data driver 130 and the scan driver 140. The display panel 150 includes pixels for displaying an image, each of which comprises subpixels SP that display different components of their respective pixels.

The subpixel is formed with a Top-Emission method, a Bottom-Emission method, or a Dual-Emission method according to a structure. The subpixels SP include a red subpixel, a green subpixel, and a blue subpixel or include a white subpixel, a red subpixel, a green subpixel, and a blue subpixel. The subpixels SP may have at least one different light emitting area according to a light emitting characteristic.

As shown in FIG. 2, in a conventional Address While Display (AWD) driving method, a data signal of 1 frame (or 1 vertical addressing time (1V addressing time)) is formed with subframes SF1-SF5. The subframes SF1-SF5 are formed to have different weighted times (or emission times).

Superordinate subframes SF1-SF3 are each formed with an addressing time (Addressing) and an emission time (Emission), and subordinate subframes SF4 and SF5 are each formed with an addressing time (Addressing), an emission time (Emission), and an erase time (Erase).

As described above, an AWD driving method is a digital driving method of adjusting Emission of an organic light emitting diode. The digital driving method divides 1 frame into a plurality of subframe SF1-SF4 and determines a gray scale with a rate of Emission.

In the AWD driving method, only when addressing of one subframe is terminated, addressing of a next subframe is performed. Therefore, when Addressing of one subframe is longer than Emission of a corresponding subframe, in order to have a time until addressing of a next subframe is started, a time that erases a data signal is required.

Each subframe represents one bit of a luminance value, and Emission of each subframe increases or reduces by approximately two times. Thus, the total emission time for the frame is proportional to the luminance value. A first subframe SF1 is a subframe in which Emission is largest among five subframes, and a fifth subframe SF5 is a subframe in which Emission is smallest among five subframes. In the drawing, Emission has size order of SF1>SF2>SF3>SF4>SF5.

In the AWD driving method, a subpixel is turned on and turned off in every subframe and in this case, luminance is determined in proportional to accumulation of a turn-on time of the subpixel. However, in a conventionally suggested AWD driving method, Erase that erases a data signal is inserted into only subordinate subframes SF4 and SF5 having a time smaller than 1V addressing.

Therefore, in a conventionally suggested AWD driving method, an error occurs that changes a voltage that determines actual luminance of a subpixel for a present subframe according to a state (turn on or turn off) of a subpixel for a previous subframe. As a result, in the conventionally suggested AWD driving method, an image quality deviation occurs due to an error occurrence factor and thus enhancement thereof is requested.

As shown in FIG. 3, in an AWD driving method according to a first exemplary embodiment of the present invention, a data signal of 1 frame is formed with subframes SF1-SF5. The subframes SF1-SF5 are formed to have different weighted times (or emission times).

In the AWD driving method according to a first exemplary embodiment of the present invention, in order to prevent an image quality deviation from occurring due to error occurrence caused in the conventionally suggested AWD driving method, entire subframes SF1-SF5 are each formed with Addressing, Emission, and Erase.

In this way, in order to solve an error in which a voltage that determines actual luminance of a subpixel for a present subframe changes according to a state (turn on or turn off) of a subpixel for a previous subframe, an AWD driving method according to a first exemplary embodiment of the present invention inserts Erase (or reset) into every subframe. Erase is defined as operation that short-circuits a first node and a second node that can control Emission.

In a first exemplary embodiment of the present invention, in order to drive a subpixel with Erase in every subframe, a circuit configuration of the subpixel is designed as follows.

Figure 4:
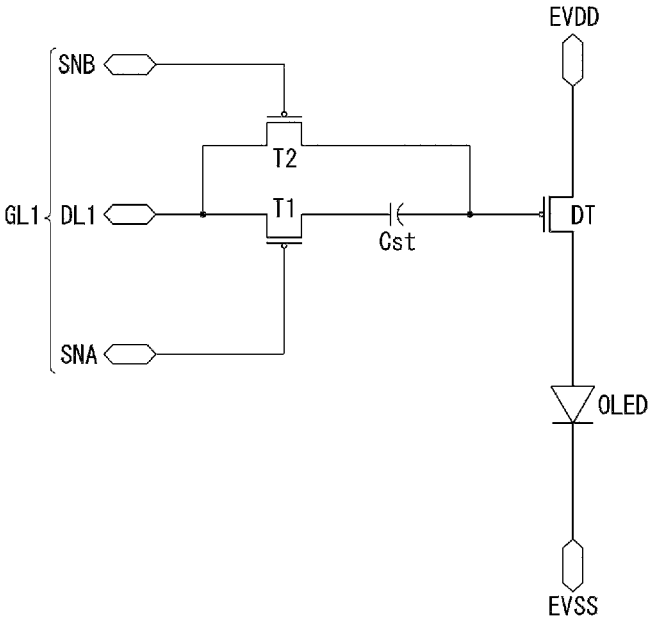
FIG. 4 is a diagram illustrating a circuit configuration of a subpixel according to a first exemplary embodiment of the present invention.
Figure 5:
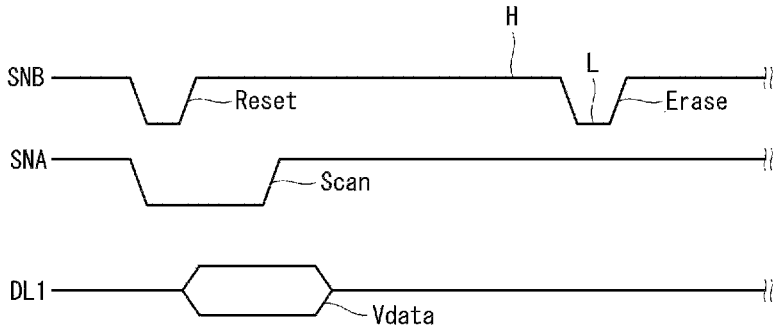
FIG. 5 is a diagram illustrating a driving waveform of the subpixel of FIG. 4.

FIG. 4 is a diagram illustrating a circuit configuration of a subpixel according to a first exemplary embodiment of the present invention, and FIG. 5 is a diagram illustrating a driving waveform of the subpixel of FIG. 4.

As shown in FIG. 4, a subpixel according to a first exemplary embodiment of the present invention includes a first scan line switch (e.g., first transistor T1), a second scan line switch (e.g., second transistor T2), a storage capacitor Cst, a driving transistor DT, and an organic light emitting diode (OLED).

In the first transistor T1, a gate electrode is connected to an Ath scan line SNA, a first electrode is connected to a first data line DL1, and a second electrode is connected to one end of the capacitor Cst. The first transistor T1 operates to correspond to an Ath scan signal supplied through the Ath scan line SNA. When the first transistor T1 is turned on, a data signal supplied through the first data line DL1 is stored at the capacitor Cst in a data voltage form.

In the second transistor T2, a gate electrode is connected to a Bth scan line SNB, a first electrode is connected to the first data line DL1, and a second electrode is connected to the other end of the capacitor Cst. The second transistor T2 operates to correspond to a Bth scan signal supplied through the Bth scan line SNB. When the second transistor T2 is turned on, a data voltage stored at the capacitor Cst is erased.

In the capacitor Cst, one end thereof is connected to a second electrode of the first transistor T1 and the other end thereof is connected to a gate electrode of the driving transistor DT and a second electrode of the second transistor T2. The capacitor Cst provides a stored data voltage to a gate electrode of the driving transistor DT.

In the driving transistor DT, a gate electrode is connected to the capacitor Cst, a first electrode is connected to a first power source line EVDD, and a second electrode is connected to an anode electrode of the OLED. The driving transistor DT operates to correspond to a data voltage stored at the capacitor Cst. The driving transistor DT turns on when the data voltage stored at the capacitor Cst meets a threshold voltage of the driving transistor during the emission time of each sub-frame and otherwise turns off (e.g., during the addressing time and the erase time).

In the OLED, an anode electrode is connected to a second electrode of the driving transistor DT and a cathode electrode is connected to a second power source line EVSS that provides current through the OLED when the driving transistor DT is turned on. The OLED emits light to correspond to a time in which the driving transistor DT is turned on.

In the foregoing description, a first electrode and a second electrode may be defined to a source electrode and a drain electrode or a drain electrode and a source electrode of a transistor according to a characteristic or a direction of the transistor.

A subpixel according to a first exemplary embodiment of the present invention operates to correspond to a scan signal supplied through two scan lines of an Ath scan line SNA and a Bth scan line SNB. The Ath scan line SNA and the Bth scan line SNB are included in a first scan line GL1. The first transistor T1 and the second transistor T2 included in a subpixel according to a first exemplary embodiment of the present invention are formed in a P type and a driving waveform thereof is shown in FIG. 5.

An Ath scan signal Scan is supplied to the Ath scan line SNA. The Ath scan signal Scan (logic low; L portion) supplied through the Ath scan line SNA defines Addressing that transfers a data signal to the subpixel. When the Ath scan signal Scan corresponding to logic low L is supplied through the Ath scan line SNA, the subpixel stores a data signal Vdata as a data voltage to correspond to Addressing.

A (B−1)th scan signal Reset and a (B−2)th scan signal Erase are supplied to the Bth scan line SNB. The (B−1)th scan signal Reset (logic low; L portion) supplied through the Bth scan line SNB defines an initialization time that initializes a subpixel. When the (B−1)th scan signal Reset corresponding to logic low L is supplied through the Bth scan line SNB, the subpixel initializes a node between the first transistor T1 and the capacitor Cst to correspond to an initialization time.

An initialization time using the (B−1)th scan signal Reset may occur before a data signal Vdata is supplied. A time point in which the (B−1)th scan signal Reset occurs may be synchronized with a time point in which the Ath scan signal Scan drops to logic low L or may be a time point a little faster than or a time point a little slower than a time point in which the Ath scan signal Scan drops to logic low L.

A (B−2)th scan signal Erase (logic low; L portion) supplied through the Bth scan line SNB defines Erase that erases a data voltage stored at a subpixel. When the (B−2)th scan signal Erase corresponding to logic low L is supplied through the Bth scan line SNB, the subpixel erases a data voltage to correspond to Erase. Particularly, the (B−2)th scan signal causes the second transistor T2 to turn on, thereby providing a discharge path to discharge the storage capacitor during the erase time of each sub-frame. A time point in which the (B−2)th scan signal Erase occurs corresponds to a time point in which Emission of each subpixel is terminated.

The (B−1)th scan signal Reset and the (B−2)th scan signal Erase erase a potential of the capacitors Cst with a method of short-circuiting a node between the first transistor T1 and the capacitor Cst by turning on the second transistor T2, but are functionally different, as described above and thus the (B−1) th scan signal Reset and the (B−2)th scan signal Erase are distinguished.

A data voltage transferred through a data line is supplied as a voltage that can emit a subpixel to correspond to Addressing, but may be changed to a voltage that cannot emit (turn off) a subpixel to correspond to an initialization time or Erase.

As can be seen through FIGS. 4 and 5, in a first exemplary embodiment of the present invention, driving of the second transistor T2 using a (B−1)th scan signal Reset and (B−2)th scan signal Erase supplied through a Bth scan line SNB, initialization driving of a subpixel based on the second transistor T2, and erasing driving thereof has been described as an example.

An initialization time is a time inserted to prevent in advance a change problem (problem by a parasitic component) of a node due to a long term that returns to Addressing after Erase and this may be omitted. Therefore, a subpixel may be erasing driven using only a (B−2)th scan signal Erase supplied through the Bth scan line SNB. That is, an initialization time may be omitted and only Erase may be used. Further, a driving waveform of FIG. 5 is an illustration and a driving waveform may be formed in different forms according to an object and an effect.

Second Exemplary Embodiment

Figure 6:
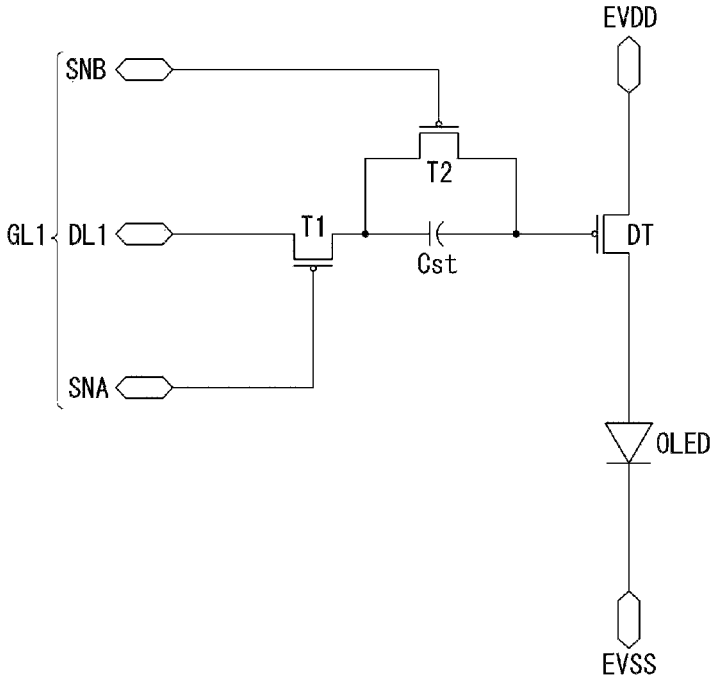
FIG. 6 is a diagram illustrating a circuit configuration of a subpixel according to a second exemplary embodiment of the present invention.
Figure 7:
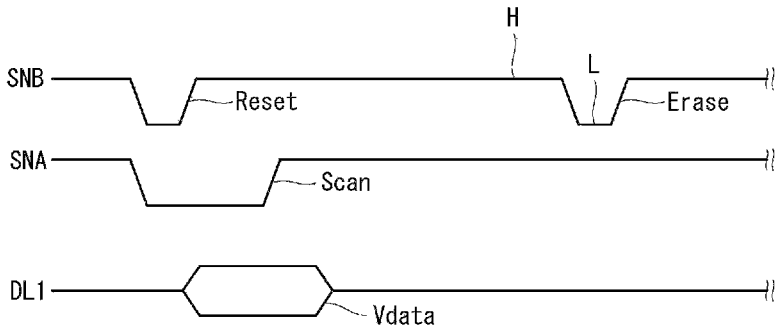
FIG. 7 is a diagram illustrating a driving waveform of the subpixel of FIG. 6.

FIG. 6 is a diagram illustrating a circuit configuration of a subpixel according to a second exemplary embodiment of the present invention, and FIG. 7 is a diagram illustrating a driving waveform of the subpixel of FIG. 6.

As shown in FIG. 6, a subpixel according to a second exemplary embodiment of the present invention includes a first transistor T1, a second transistor T2, a capacitor Cst, a driving transistor DT, and an OLED.

In the first transistor T1, a gate electrode is connected to an Ath scan line SNA, a first electrode is connected to a first data line DL1, and a second electrode is connected to one end of the capacitor Cst. The first transistor T1 operates to correspond to an Ath scan signal supplied through the Ath scan line SNA. When the first transistor T1 is turned on, a data signal supplied through the first data line DL1 is stored at the capacitor Cst in a data voltage form.

In the second transistor T2, a gate electrode is connected to a Bth scan line SNB, a first electrode is connected to one end of the capacitor Cst, and a second electrode is connected to the other end of the capacitor Cst. The second transistor T2 operates to correspond to the Bth scan signal supplied through the Bth scan line SNB. When the second transistor T2 is turned on, a data voltage stored at the capacitor Cst is erased.

In the capacitor Cst, one end thereof is connected to a second electrode of the first transistor T1 and a first electrode of the second transistor T2 and the other end thereof is connected to a gate electrode of the driving transistor DT and a second electrode of the second transistor T2. The capacitor Cst provides a stored data voltage to a gate electrode of the driving transistor DT.

In the driving transistor DT, a gate electrode is connected to the capacitor Cst, a first electrode is connected to a first power source line EVDD, and a second electrode is connected to an anode electrode of the OLED. The driving transistor DT operates to correspond to a data voltage stored at the capacitor Cst.

In the OLED, an anode electrode is connected to a second electrode of the driving transistor DT and a cathode electrode is connected to a second power source line EVSS. The OLED emits light to correspond to a time in which the driving transistor DT is turned on.

In the foregoing description, the first electrode and the second electrode may be defined to a source electrode and a drain electrode or a drain electrode and a source electrode of a transistor according to a characteristic or a direction of the transistor.

A subpixel according to a second exemplary embodiment of the present invention operates to correspond to a scan signal supplied through two scan lines of an Ath scan line SNA and a Bth scan line SNB. The Ath scan line SNA and the Bth scan line SNB are included in a first scan line GL1. The first transistor T1 and the second transistor T2 included in a subpixel according to a second exemplary embodiment of the present invention are formed in a P type and a driving waveform thereof is shown in FIG. 7.

An Ath scan signal Scan is supplied to the Ath scan line SNA. The Ath scan signal Scan (logic low; L portion) supplied through the Ath scan line SNA defines Addressing that transfers a data signal to the subpixel. When the Ath scan signal Scan corresponding to logic low L is supplied through the Ath scan line SNA, the subpixel stores a data signal Vdata as a data voltage to correspond to Addressing.

A (B−1)th scan signal Reset and a (B−2)th scan signal Erase are supplied to the Bth scan line SNB. The (B−1)th scan signal Reset (logic low; L portion) supplied through the Bth scan line SNB defines an initialization time that initializes a subpixel. When the (B−1)th scan signal Reset corresponding to logic low L is supplied through the Bth scan line SNB, the subpixel initializes nodes of both ends of the capacitor Cst to correspond to an initialization time.

An initialization time using the (B−1)th scan signal Reset may occur before a data signal Vdata is supplied. A time point in which the (B−1)th scan signal Reset occurs may be synchronized with a time point in which the Ath scan signal Scan drops to logic low L or may be a time point a little faster than or a time point a little slower than a time point in which the Ath scan signal Scan drops to logic low L.

A (B−2)th scan signal Erase (logic low; L portion) supplied through the Bth scan line SNB defines Erase that erases a data voltage stored at a subpixel. When the (B−2)th scan signal Erase corresponding to logic low L is supplied through the Bth scan line SNB, the subpixel erases a data voltage to correspond to Erase. A time point in which the (B−2)th scan signal Erase occurs corresponds to a time point in which Emission of each subpixel is terminated.

The (B−1)th scan signal Reset and the (B−2)th scan signal Erase erase a potential of the capacitors Cst with a method of short-circuiting nodes of both ends of the capacitor Cst by turning on the second transistor T2, but are functionally different, as described above and thus the (B−1)th scan signal Reset and the (B−2)th scan signal Erase are distinguished.

A data voltage transferred through a data line is supplied as a voltage that can emit a subpixel to correspond to Addressing, but may be changed to a voltage that cannot emit (turn off) a subpixel to correspond to an initialization time or Erase.

As can be seen through FIGS. 6 and 7, in a second exemplary embodiment of the present invention, driving of the second transistor T2 using a (B−1)th scan signal Reset and a (B−2)th scan signal Erase supplied through the Bth scan line SNB, initialization driving of a subpixel based on the second transistor T2, and erasing driving thereof has been described as an example.

An initialization time is a time inserted to prevent in advance a change problem (problem by a parasitic component) of a node due to a long term that returns to Addressing after Erase and this may be omitted. Therefore, a subpixel may be erasing driven using only a (B−2)th scan signal Erase supplied through the Bth scan line SNB. That is, an initialization time may be omitted and only Erase may be used. Further, a driving waveform of FIG. 7 is an illustration and a driving waveform may be formed in different forms according to an object and an effect.

Third Exemplary Embodiment

Figure 8:
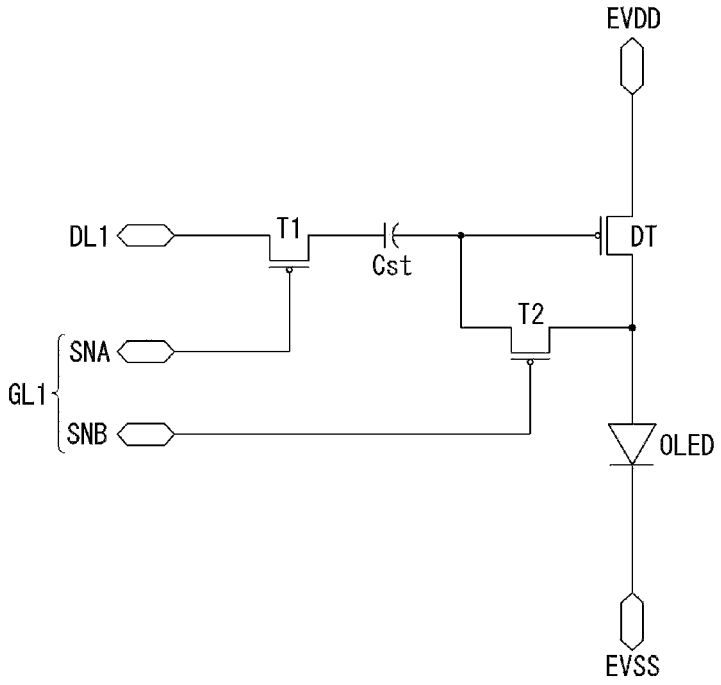
FIG. 8 is a diagram illustrating a circuit configuration of a subpixel according to a third exemplary embodiment of the present invention.
Figure 9:
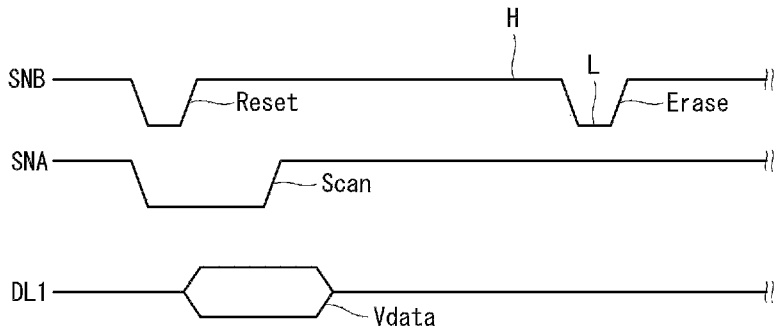
FIG. 9 is a diagram illustrating a driving waveform of the subpixel of FIG. 8.

FIG. 8 is a diagram illustrating a circuit configuration of a subpixel according to a third exemplary embodiment of the present invention, and FIG. 9 is a diagram illustrating a driving waveform of the subpixel of FIG. 8.

As shown in FIG. 8, a subpixel according to a third exemplary embodiment of the present invention includes a first transistor T1, a second transistor T2, a capacitor Cst, a driving transistor DT, and an OLED.

In the first transistor T1, a gate electrode is connected to an Ath scan line SNA, a first electrode is connected to a first data line DL1, and a second electrode is connected to one end of the capacitor Cst. The first transistor T1 operates to correspond to an Ath scan signal supplied through the Ath scan line SNA. When the first transistor T1 is turned on, a data signal supplied through the first data line DL1 is stored at the capacitor Cst in a data voltage form.

In the second transistor T2, a gate electrode is connected to a Bth scan line SNB, a first electrode is connected to the other end of the capacitor Cst and a gate electrode of the driving transistor DT, and a second electrode is connected to a second electrode of the driving transistor DT. The second transistor T2 operates to correspond to a Bth scan signal supplied through the Bth scan line SNB. When the second transistor T2 is turned on, a node of a gate electrode of the driving transistor DT and a node of a second electrode are short-circuited, the driving transistor DT is turned off by a high voltage (e.g., because a voltage higher than Vgs=0 is applied) flowing through the second electrode. In addition, a data voltage stored at the capacitor Cst is erased by a high voltage flowing through the second electrode.

In the capacitor Cst, one end thereof is connected to a second electrode of the first transistor T1 and a first electrode of the second transistor T2 and the other end thereof is connected to a gate electrode of the driving transistor DT and a second electrode of the second transistor T2. The capacitor Cst provides a stored data voltage to a gate electrode of the driving transistor DT.

In the driving transistor DT, a gate electrode is connected to the capacitor Cst, a first electrode is connected to a first power source line EVDD, and a second electrode is connected to an anode electrode of the OLED. The driving transistor DT operates to correspond to a data voltage stored at the capacitor Cst.

In the OLED, an anode electrode is connected to a second electrode of the driving transistor DT and a cathode electrode is connected to a second power source line EVSS. The OLED emits light to correspond to a time in which the driving transistor DT is turned on.

In the foregoing description, the first electrode and the second electrode may be defined to a source electrode and a drain electrode or a drain electrode and a source electrode of a transistor according to a characteristic or a direction of the transistor.

A subpixel according to a third exemplary embodiment of the present invention operates to correspond to a scan signal supplied through two scan lines of an Ath scan line SNA and a Bth scan line SNB. The Ath scan line SNA and the Bth scan line SNB are included in a first scan line GL1. The first transistor T1 and the second transistor T2 included in a subpixel according to a third exemplary embodiment of the present invention are formed in a P type and a driving waveform thereof is shown in FIG. 9.

An Ath scan signal Scan is supplied to the Ath scan line SNA. The Ath scan signal Scan (logic low; L portion) supplied through the Ath scan line SNA defines Addressing that transfers a data signal to the subpixel. When the Ath scan signal Scan corresponding to logic low L is supplied through the Ath scan line SNA, the subpixel stores a data signal Vdata as a data voltage to correspond to Addressing.

A (B−1)th scan signal Reset and a (B−2)th scan signal Erase are supplied to the Bth scan line SNB. The (B−1)th scan signal Reset (logic low; L portion) supplied through the Bth scan line SNB defines an initialization time that initializes a subpixel. When the (B−1)th scan signal Reset corresponding to logic low L is supplied through the Bth scan line SNB, the subpixel short-circuits and initializes a node of the gate electrode of the driving transistor DT and a node of the second electrode to correspond to an initialization time.

An initialization time using the (B−1)th scan signal Reset may occur before a data signal Vdata is supplied. A time point in which the (B−1)th scan signal Reset occurs may be synchronized with a time point in which the Ath scan signal Scan drops to logic low L or may be a time point a little faster than or a time point a little slower than a time point in which the Ath scan signal Scan drops to logic low L.

A (B−2)th scan signal Erase (logic low; L portion) supplied through the Bth scan line SNB defines Erase that erases a data voltage stored at a subpixel. When the (B−2)th scan signal Erase corresponding to logic low L is supplied through the Bth scan line SNB, the subpixel erases a data voltage to correspond to Erase. A time point in which the (B−2)th scan signal Erase occurs corresponds to a time point in which Emission of each subpixel is terminated.

The (B−1)th scan signal Reset and the (B−2)th scan signal Erase erase a potential of the capacitors Cst with a method of short-circuiting a node of the gate electrode of the driving transistor DT and a node of the second electrode by turning on the second transistor T2, but are functionally different, as described above and thus the (B−1)th scan signal Reset and the (B−2)th scan signal Erase are distinguished.

A data voltage transferred through a data line is supplied as a voltage that can emit a subpixel to correspond to Addressing, but may be changed to a voltage that cannot emit (turn off) a subpixel to correspond to an initialization time or Erase.

As can be seen through FIGS. 8 and 9, in a third exemplary embodiment of the present invention, driving of the second transistor T2 using a (B−1)th scan signal Reset and (B−2)th scan signal Erase supplied through the Bth scan line SNB, initialization driving of a subpixel based on the second transistor T2, and erasing driving thereof has been described as an example.

An initialization time is a time inserted to prevent in advance a change problem (problem by a parasitic component) of a node due to a long term that returns to Addressing after Erase and this may be omitted. Therefore, a subpixel may be erasing driven using only a (B−2)th scan signal Erase supplied through the Bth scan line SNB. That is, an initialization time may be omitted and only Erase may be used. Further, a driving waveform of FIG. 9 is an illustration and a driving waveform may be formed in different forms according to an object and an effect.

Fourth Exemplary Embodiment

Figure 10:
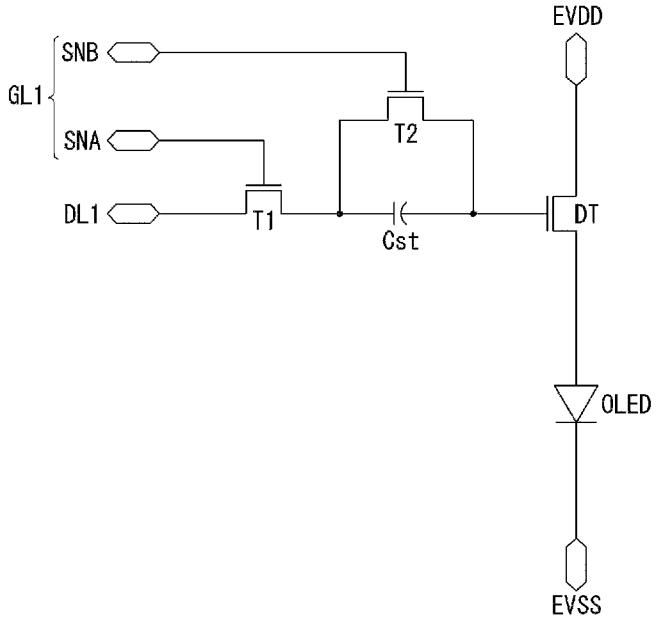
FIG. 10 is a diagram illustrating a circuit configuration of a subpixel according to a fourth exemplary embodiment of the present invention.
Figure 11:
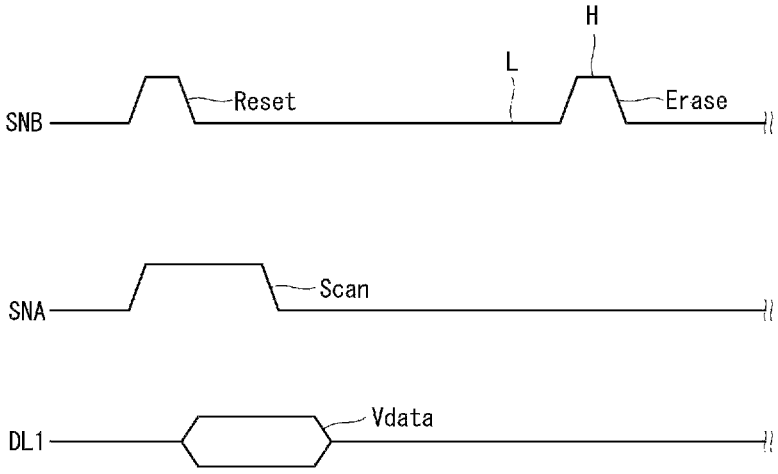
FIG. 11 is a diagram illustrating a driving waveform of the subpixel of FIG. 10.

FIG. 10 is a diagram illustrating a circuit configuration of a subpixel according to a fourth exemplary embodiment of the present invention and FIG. 11 is a diagram illustrating a driving waveform of the subpixel of FIG. 10.

As shown in FIG. 10, a subpixel according to a fourth exemplary embodiment of the present invention includes a first transistor T1, a second transistor T2, a capacitor Cst, a driving transistor DT, and an OLED.

In the first transistor T1, a gate electrode is connected to an Ath scan line SNA, a first electrode is connected to a first data line DL1, and a second electrode is connected to one end of the capacitor Cst. The first transistor T1 operates to correspond to an Ath scan signal supplied through the Ath scan line SNA. When the first transistor T1 is turned on, a data signal supplied through the first data line DL1 is stored at the capacitor Cst in a data voltage form.

In the second transistor T2, a gate electrode is connected to a Bth scan line SNB, a first electrode is connected to one end of the capacitor Cst, and a second electrode is connected to the other end of the capacitor Cst. The second transistor T2 operates to correspond to a Bth scan signal supplied through the Bth scan line SNB. When the second transistor T2 is turned on, a data voltage stored at the capacitor Cst is erased.

In the capacitor Cst, one end thereof is connected to a second electrode of the first transistor T1 and a first electrode of the second transistor T2 and the other end thereof is connected to a gate electrode of the driving transistor DT and a second electrode of the second transistor T2. The capacitor Cst provides a stored data voltage to a gate electrode of the driving transistor DT.

In the driving transistor DT, a gate electrode is connected to the capacitor Cst, a first electrode is connected to a first power source line EVDD, and a second electrode is connected to an anode electrode of the OLED. The driving transistor DT operates to correspond to a data voltage stored at the capacitor Cst.

In the OLED, an anode electrode is connected to a second electrode of the driving transistor DT and a cathode electrode is connected to a second power source line EVSS. The OLED emits light to correspond to a time in which the driving transistor DT is turned on.

In the foregoing description, a first electrode and a second electrode may be defined to a source electrode and a drain electrode or a drain electrode and a source electrode of a transistor according to a characteristic or a direction of the transistor.

A subpixel according to a fourth exemplary embodiment of the present invention operates to correspond to a scan signal supplied through two scan lines of an Ath scan line SNA and a Bth scan line SNB. The Ath scan line SNA and the Bth scan line SNB are included in a first scan line GL1. The first transistor T1 and the second transistor T2 included in a subpixel according to a fourth exemplary embodiment of the present invention are formed in an N type and a driving waveform thereof is shown in FIG. 11.

An Ath scan signal Scan is supplied to the Ath scan line SNA. The Ath scan signal Scan (logic high; H portion) supplied through the Ath scan line SNA defines Addressing that transfers a data signal to the subpixel. When the Ath scan signal Scan corresponding to logic high H is supplied through the Ath scan line SNA, the subpixel stores a data signal Vdata as a data voltage to correspond to Addressing.

A (B−1)th scan signal Reset and a (B−2)th scan signal Erase are supplied to the Bth scan line SNB. The (B−1)th scan signal Reset (logic high; H portion) supplied through the Bth scan line SNB defines an initialization time that initializes a subpixel. When the (B−1)th scan signal Reset corresponding to logic high H is supplied through the Bth scan line SNB, the subpixel initializes nodes of both ends of the capacitor Cst to correspond to an initialization time.

An initialization time using the (B−1)th scan signal Reset may occur before a data signal Vdata is supplied. A time point in which the (B−1)th scan signal Reset occurs may be synchronized with a time point in which the Ath scan signal Scan rises to logic high H or may be a time point a little faster than or a time point a little slower than a time point in which the Ath scan signal Scan rises to logic high H.

A (B−2)th scan signal Erase (logic high; H portion) supplied through the Bth scan line SNB defines Erase that erases a data voltage stored at a subpixel. When the (B−2)th scan signal corresponding to logic high H is supplied through the Bth scan line SNB, the subpixel erases a data voltage to correspond to Erase. A time point in which the (B−2)th scan signal Erase occurs corresponds to a time point in which Emission of each subpixel is terminated.

The (B−1)th scan signal Reset and the (B−2)th scan signal Erase erase a potential of the capacitors Cst with a method of short-circuiting nodes of both ends of the capacitor Cst by turning on the second transistor T2, but are functionally different, as described above and thus the (B−1)th scan signal Reset and the (B−2)th scan signal Reset are distinguished.

A data voltage transferred through a data line is supplied as a voltage that can emit a subpixel to correspond to Addressing, but may be changed to a voltage that cannot emit (turn off) a subpixel to correspond to an initialization time or Erase.

As can be seen through FIGS. 10 and 11, in a fourth exemplary embodiment of the present invention, driving of the second transistor T2 using a (B−1)th scan signal Reset and (B−2)th scan signal Erase supplied through the Bth scan line SNB, initialization driving of a subpixel based on the second transistor T2, and erasing driving thereof has been described as an example.

An initialization time is a time inserted to prevent in advance a change problem (problem by a parasitic component) of a node due to a long term that returns to Addressing after Erase and this may be thus omitted. Therefore, a subpixel may be erasing driven using only a (B−2)th scan signal Erase supplied through the Bth scan line SNB. That is, an initialization time may be omitted and only Erase may be used. Further, a driving waveform of FIG. 11 is an illustration, and a driving waveform may be formed in different forms according to an object and an effect.

First to fourth exemplary embodiments of the present invention use a subpixel that can easily apply Erase that can enhance driving accuracy by removing (or preventing) an error occurrence factor upon digital driving. Therefore, the present invention can be applied to an Address Display Separation (ADS) driving method in which Addressing and Emission are separated as well as an AWD driving method.

First to fourth exemplary embodiments of the present invention illustrate subframes sequentially disposed from a lowermost bit LSB to an uppermost bit MSB as an example. However, this is an illustration, and in order to form the optical center in various forms, a subframe may be randomly disposed from a lowermost bit LSB to an uppermost bit MSB. Further, first to fourth exemplary embodiments of the present invention illustrate five subframes formed within one frame as an example. However, this is an illustration, and the number of subframes may be formed with various numbers of four, six, and eight.

As described above, the present invention can enhance a problem that an image quality deviation occurs due to an error occurrence factor in which a voltage that determines actual luminance of a subpixel for a subframe changes. Further, the present invention can enhance driving accuracy and improve a display quality by removing (or preventing) an error occurrence factor with elements of the small number.

What is claimed is:

1. A display device comprising:

a display panel comprising a plurality of pixels for displaying an image, each of the plurality of pixels comprising a plurality of subpixels for displaying different components of the pixels;

a data driver to supply a data signal to the display panel to control luminance of the plurality of pixels, the data signal comprising a plurality of frames, each of the frames comprising a plurality of sub-frames, each of the sub-frames comprising an addressing time, followed by an emission time, and followed by an erase time;

a scan driver to supply first and second scan line signals to the display panel;

wherein each of the subpixels is driven by the frames including the plurality of subframes and comprises:

a first scan line switch controlled by the first scan line signal to turn on during the addressing time of each sub-frame and to turn off during the emission time and the erase time of each sub-frame;

a storage capacitor to store a data voltage corresponding to the data signal when the first scan line switch is on during the addressing time of each sub-frame and to discharge the data voltage during the erase time of each sub-frame;

a driving transistor having a gate electrode coupled to the storage capacitor, the driving transistor to turn on during the emission time of each sub-frame when the data voltage of the storage capacitor meets a threshold voltage of the driving transistor and to turn off during the addressing time and the erase time of each sub-frame when the data voltage does not meet the threshold voltage;

a light emitting diode coupled to the driving transistor and to emit light when the driving transistor is on during the emission time to drive current through the light emitting diode;

a second scan line switch controlled by the second scan line signal to provide a discharge path to discharge the storage capacitor during the erase time of each sub-frame.

2. The display device of claim 1, wherein the first scan line switch comprises a first electrode coupled to a data line supplying the data voltage, a second electrode coupled to a first end of the storage capacitor, and a gate electrode coupled to the first scan line signal; and the driving transistor comprises a first electrode coupled to a power supply, a second electrode coupled to the light emitting diode, and a gate electrode coupled to a second end of the storage capacitor.

3. The display device of claim 2, wherein the second scan line switch comprises:

a gate electrode coupled to receive the second scan line signal;

a first electrode coupled to the data line supplying the data voltage; and a second electrode coupled to the second end of the storage capacitor.

4. The display device of claim 2, wherein the second scan line switch comprises:

a gate electrode coupled to receive the second scan line signal;

a first electrode coupled to the first end of the storage capacitor; and a second electrode coupled to the second end of the storage capacitor.

5. The display device of claim 2, wherein the second scan line switch comprises:

a gate electrode coupled to receive the second scan line signal;

a first electrode coupled to the gate electrode of the driving transistor; and a second electrode coupled the second electrode of the driving transistor.

6. The display device of claim 2, wherein the first scan line switch, the second scan line switch, and the driving transistor each comprise a p-type transistor.

7. The display device of claim 2, wherein the first scan line switch, the second scan line switch, and the driving transistor each comprise an n-type transistor.

8. The display device of claim 1, wherein each sub-frame corresponds to a bit of a luminance value, and each sub-frame has a different length emission time such that a total emission time for the frame is proportional to the luminance value.

9. The display device of claim 1, wherein the second scan line switch controlled by the second scan line signal is further to turn on during a reset time of each sub-frame to provide the discharge path to discharge the storage capacitor during the reset time.

10. A method for driving a display device comprising a plurality of pixels for displaying an image, each of the plurality of pixels comprising a plurality of subpixels for displaying different components of the pixels, the method comprising:

supplying, by a data driver, a data signal to the display panel to control luminance of the plurality of pixels, the data signal comprising a plurality of frames, each of the frames comprising a plurality of sub-frames, each of the sub-frames comprising an addressing time, followed by an emission time, and followed by an erase time;

supplying by a scan driver, first and second scan line signals to the display panel;

during the addressing time of each sub-frame, controlling a first scan line switch via the first scan line signal to turn on to couple a storage capacitor to the data signal and to cause the storage capacitor to store a data voltage corresponding to the data signal;

responsive to the data voltage of the storage capacitor meeting a threshold voltage of a driving transistor having a gate electrode coupled to the storage capacitor, causing the driving transistor to turn on during the emission time of each sub-frame;

turning off the first scan line switch during the emission time of each sub-frame;

when the driving transistor is on during the emission time of each sub-frame, causing a drive current to flow through a light emitting diode, the light emitting diode emitting light in response to the drive current;

during the erase time of each sub-frame, controlling a second scan line switch via the second scan line signal to turn on, the second scan line switch providing a discharge path to discharge the data voltage of the storage capacitor and causing the driving transistor to turn off and causing the light emitting diode to cease emitting light.

11. The display device of claim 10, wherein each sub-frame corresponds to a bit of a luminance value, and each sub-frame has a different length emission time such that a total emission time for the frame is proportional to the luminance value.

12. The method claim 10, further comprising:

causing the storage capacitor to discharge during a reset time of each sub-frame prior to the addressing time of each sub-frame.

13. The method of claim 12, wherein causing the storage capacitor to discharge during the reset time of each sub-frame comprises:

controlling the second scan line switch via the second scan line control signal to turn on during a reset time of each sub-frame.

* * * * *